United States Patent [19]

Wohlfeil

[11] 4,417,540

[45] Nov. 29, 1983

[54] COATING APPARATUS WITH AIR-NOZZLE ARRANGEMENT

[75] Inventor: Gerhard Wohlfeil, Monheim, Fed. Rep. of Germany

[73] Assignee: Jagenberg Werke AG, Dusseldorf, Fed. Rep. of Germany

[21] Appl. No.: 327,875

[22] Filed: Dec. 7, 1981

[30] Foreign Application Priority Data

Dec. 19, 1980 [DE] Fed. Rep. of Germany ..... 3048133

[51] Int. Cl.[3] ..... B05C 11/06

[52] U.S. Cl. ..... 118/63; 427/348

[58] Field of Search ..... 118/63, 62, 21, 410; 427/348, 349; 15/306 A; 239/589, DIG. 21; 425/381

[56] References Cited

U.S. PATENT DOCUMENTS 2,139,628 12/1938 Terry ..... 118/63 X 2,784,697 3/1957 Uhleen ..... 118/413 X

FOREIGN PATENT DOCUMENTS 784657 8/1955 United Kingdom ..... 118/63

*Primary Examiner*—John P. McIntosh

*Attorney, Agent, or Firm*—Sprung, Horn, Kramer & Woods

[57] ABSTRACT

In an apparatus for the continuous, uniform coating with a liquid coating material of a web passing over a counter roll, comprising an air-nozzle arrangement for the removal of excess coating material and the smoothing of the coating, said air-nozzle arrangement being rotatable about its longitudinal center axis, being disposed adjacent to the counter roll and comprising two slot nozzles disposed symmetrically about its longitudinal center axis and displaced 180 degrees relative to each other, each nozzle extending at least over the width of the web, and the two lips of each nozzle being seated on nozzle-lip holders mounted on the casing of the air-nozzle arrangement, the improvement which comprises imparting to the nozzle-lip holders an angular construction and mounting them on the casing in such a way that they can be positioned and adjusted in the direction of the nozzle-slot width; one of the nozzle-lip holders being of smaller cross section over its angled area than the other nozzle-lip holder; the nozzle-lip holders of each slot nozzle being interconnected through adjustable means exerting a pulling and pushing action and which are distributed over the length of the slot nozzle.

4 Claims, 1 Drawing Figure

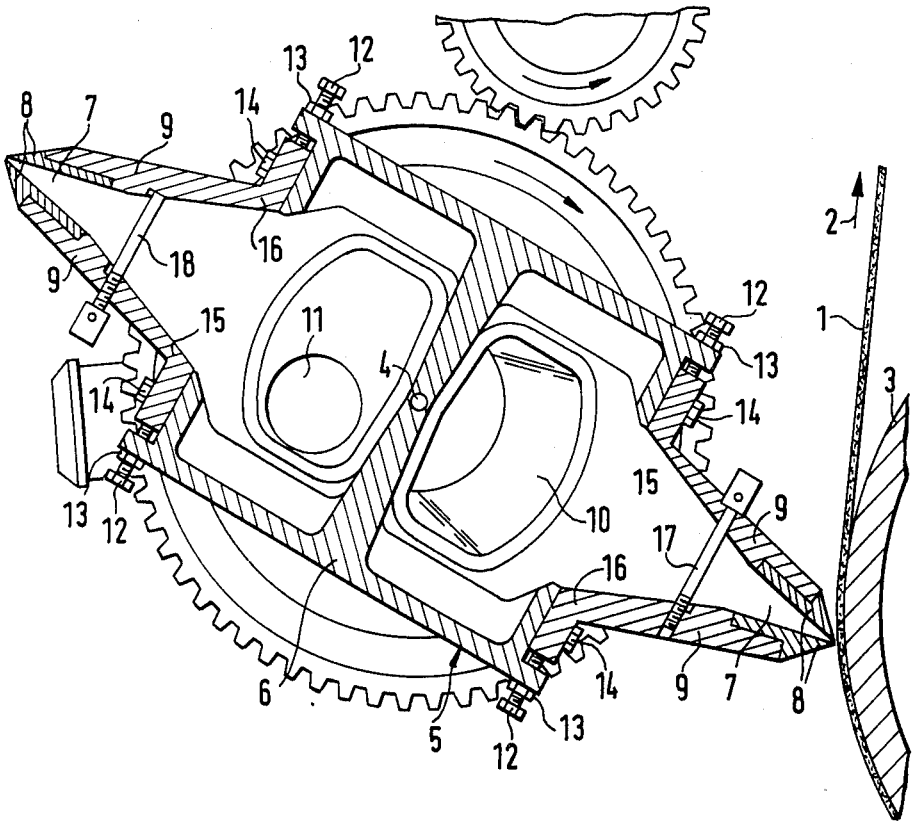
8
7
9
14
13
12
18
16
9
15
11
4
14
13
12
6
5
12
13
14
10
15
12
13
14
2
1
3
9
17
16
14
9
7
8

COATING APPARATUS WITH AIR-NOZZLE ARRANGEMENT

BACKGROUND OF THE INVENTION

The invention relates to an apparatus for the continuous, uniform coating with a liquid coating material of a web passing over a counter roll, which comprises an air-nozzle arrangement, rotatable about its longitudinal center axis and disposed adjacent to said counter roll, for the removal of excess coating material from the web and the smoothing of the coating, said air-nozzle arrangement comprising two slot nozzles symmetrically disposed about its longitudinal center axis and displaced 180 degrees relative to each other, each nozzle extending at least over the width of the web, and the two lips of each nozzle being disposed on nozzle-lip holders mounted on the casing of the air nozzle arrangement.

A coating apparatus of this type is known from U.S. Pat. No. 2,766,720, for example. The rotatable air-nozzle arrangement of that coating apparatus permits one of the slot nozzles to be used to clean the opposite slot nozzle, rotated out of the working position, and to ready it for deployment while the coating apparatus is in operation. This prior-art apparatus incorporates no special provision for setting and adjusting the nozzle slot. Now it has been found that especially in coating apparatuses of this type for wide webs the nozzle slot will sag, with the result that its spacing from the web to be coated will be nonuniform.

SUMMARY OF THE INVENTION

The object of the invention is to provide an apparatus of the type outlined above which comprises an air-nozzle arrangement wherein the slot nozzle, though of a material- and weight-saving design, can be relied on to be absolutely straight and capable of being precisely set and reset.

In accordance with the invention, this object is accomplished in that the nozzle-lip holders, which are of angular construction, are mounted on the casing in such a way that they can be positioned and adjusted in the direction of the nozzle-slot width; that one of the nozzle-lip holders has a cross section over the angled area that is smaller than that of the other nozzle-lip holder; and that the nozzle-lip holders of each slot nozzle are interconnected through adjustable means exerting a pulling and pushing action which are distributed over the length of the slot nozzle.

Since the nozzle-lip holders are positionable and adjustable in the direction of the nozzle-slot width, it is possible to precisely set the nozzle lips in a straight line. The pulling and pushing means then permit fine adjustment of the nozzle-slot width in which the nozzle-lip holder of reduced cross section is adjusted relative to the nozzle-lip holder of unreduced cross section, which provides a line substantially free of bends as a basis for adjustment.

The nozzle-lip holders are advantageously positionable by means of adjusting screws with lock nuts distributed over the length of the air-nozzle arrangement and fixed to the casing by means of setscrews disposed at right angles to said adjusting screws. This makes for a design that is particularly simple with respect to construction and maintenance.

The pulling and pushing means are preferably traction and thrust screws,

The nozzle-lip holder of reduced cross section is preferably the one which is the upper nozzle-lip holder when the slot nozzle is in the position in which it is directed toward the counter roll.

In an advantageous embodiment of the air-nozzle arrangement in accordance with the invention, a feed duct for primary air and a feed duct for cleaning air are arranged in such a way that primary air can be fed to the slot nozzle which is directed toward the counter roll, and cleaning air to the slot nozzle which is directed away from the counter roll. The feed duct for cleaning air advantageously has a smaller cross section than the feed duct for primary air.

BRIEF DESCRIPTION OF THE DRAWING

An embodiment of the invention is illustrated in the accompanying drawing and will now be described in greater detail.

The single FIGURE of the drawing shows an air-nozzle arrangement in accordance with the invention in cross section.

DETAILED DESCRIPTION OF THE INVENTION

In the coating apparatus shown in the drawing, a web 1 to be coated passes in the direction of the arrow 2 over a counter roll 3. For the removal of excess coating material from the web 1 and for the smoothing of the coating, there is provided an air-nozzle arrangement 5 which is rotatable about its longitudinal center axis 4 and comprises a casing 6, and which further comprises two slot nozzles 7, symmetrically disposed about its longitudinal center axis and displaced 180 degrees relative to each other, each of these nozzles having nozzle lips 8 and extending at least over the width of the web. The nozzle lips 8 are seated on angular nozzle-lip holders 9 which are mounted on the casing 6 in such a way that they can be positioned and adjusted relative to said casing in the direction of the nozzle-slot width.

The air feed to the slot nozzle 7 directed toward the counter roll 3 is through a feed duct 10 for primary air while the air feed to the slot nozzle 7 directed away from the counter roll 3 is through a feed duct 11 for cleaning air. The cleaning-air feed duct 11 is of smaller cross section than the primary-air feed duct 10. This air-nozzle arrangement permits the slot nozzle 7 which is not in use to be cleaned and, if necessary, adjusted while the apparatus is in operation. The cleaned slot nozzle 7 can then readily and quickly be rotated into its operating position at the counter roll 3, following which the slot nozzle 7 which was in use before can be cleaned and adjusted.

The nozzle-lip holders 9 can readily be positioned and adjusted relative to the casing 6 in the direction of the nozzle-slot width by means of adjusting screws 12 and lock nuts 13. When properly positioned, they can be fixed in position by means of setscrews 14. These positioning means permit precise rectilinear positioning of the nozzle lips 8.

The nozzle-lip holder 9 which is the upper one when the slot nozzle (7) is directed toward the counter roll 3 has a cross section over the angled area 15 that is smaller than the cross section of the lower nozzle-lip holder 9 over the angled area 16. The legs of the nozzle-lip holders 9 which extend beyond the casing 9 are interconnected through traction screws 17 and thrust screws 18 distributed over the length of the slot nozzle 7. Fine adjustment of the width of the nozzle slot can be readily secured through these traction and thrust screws. The nozzle-lip holder 9 with the larger cross section over the angled area 16 provides a base line that is substantially free of bends for adjustment.

The arrangement in accordance with the invention permits precise adjustment of the nozzle slot with respect to its width and straightness by simple means, especially when wide webs 1 are being handled. This provides assurance of absolutely uniform distribution of the coating material over the entire width of the web.

It will be appreciated that the instant specification and claims are set forth by way of illustration and not of limitation, and that various modifications and changes may be made without departing from the spirit and scope of the present invention.

What is claimed is:

1. In an apparatus for the continuous, uniform coating with a liquid coating material of a web passing over a counter roll, comprising an air-nozzle arrangement for the removal of excess coating material and the smoothing of a coating, said air-nozzle arrangement being rotatable about its longitudinal center axis, being disposed adjacent to the counter roll and comprising two slot nozzles disposed symmetrically about its longitudinal center axis and displaced 180 degrees relative to each other, each nozzle extending at least over the width of the web, each nozzle including upper and lower lips seated on nozzle-lip holders mounted on the casing of the air-nozzle arrangement and sloping downwardly toward one another to form the nozzle opening, the improvement which comprises imparting to the nozzle-lip holders an angular construction and mounting them on the casing in such a way that they can be position and adjusted in the direction of the nozzle-slot width; the nozzle-lip holder which is uppermost in operative position being thinner along a line extending transversely of its angled downwardly sloping area than the lower nozzle-lip holder; the nozzle-lip holders of each slot nozzle being interconnected through traction screws and thrust screws exerting a pulling and pushing action and which are distributed over the length of the slot nozzle, the apparatus further including adjusting screws with lock nuts distributed over the length of the air-nozzle arrangement and operatively connected to the nozzle-lip holders for positioning thereof, and set-screws disposed at right angles to said adjusting screws for fixing the nozzle-lip holders to the casing.

2. An apparatus according to claim 1, wherein the nozzle-lip holder of lesser cross section is that which is the upper nozzle-lip holder when the slot nozzle is directed toward the counter roll.

3. An apparatus according to claim 1, including a feed duct for primary air and a feed duct for cleaning air arranged in such a way that the slot nozzle can be supplied with primary air when it is directed toward the counter roll and with cleaning air when it is directed away from the counter roll.

4. An apparatus according to claim 3, wherein the feed duct for cleaning air is of smaller cross section than the feed duct for primary air.

* * * * *